US009410282B2

(12) United States Patent
Herman et al.

(10) Patent No.: US 9,410,282 B2
(45) Date of Patent: Aug. 9, 2016

(54) METHOD AND APPARATUS FOR DRYING ARTICLES

(71) Applicant: Whirlpool Corporation, Benton Harbor, MI (US)

(72) Inventors: Mark L. Herman, Saint Joseph, MI (US); Daniel M. Putnam, Holland, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 450 days.

(21) Appl. No.: 14/044,092

(22) Filed: Oct. 2, 2013

(65) Prior Publication Data

US 2015/0089829 A1 Apr. 2, 2015

(51) Int. Cl.

| | |
|---|---|
| ***F26B 3/347*** | (2006.01) |
| ***D06F 58/28*** | (2006.01) |
| ***D06F 58/04*** | (2006.01) |
| ***D06F 58/26*** | (2006.01) |

(52) U.S. Cl.

CPC ..... *D06F 58/28* (2013.01); *D06F 58/04* (2013.01); *D06F 58/266* (2013.01); *F26B 3/347* (2013.01); *D06F 2058/289* (2013.01); *D06F 2058/2809* (2013.01)

(58) Field of Classification Search

CPC ..... D06F 58/28; D06F 58/04; D06F 58/266; D06F 2058/2809; D06F 2058/289; F26B 3/347

See application file for complete search history.

(56) References Cited

U.S. PATENT DOCUMENTS

| | | | | |
|---|---|---|---|---|
| 3,439,431 | A | 4/1969 | Heidtmann | |
| 6,124,584 | A | 9/2000 | Blaker et al. | |
| 2011/0308101 | A1 | 12/2011 | Wisherd et al. | |
| 2012/0164022 | A1 | 6/2012 | Muginstein et al. | |
| 2012/0291304 | A1 | 11/2012 | Wisherd et al. | |
| 2015/0102801 | A1 * | 4/2015 | Herman | H05B 6/62 324/96 |

FOREIGN PATENT DOCUMENTS

| | | | |
|---|---|---|---|
| WO | 2012001523 | A2 | 1/2012 |

* cited by examiner

*Primary Examiner* — Jiping Lu

(57) ABSTRACT

A method and apparatus for drying textile material with a radio frequency (RF) applicator and a controller, the method includes energizing the RF applicator to generate a field of electromagnetic radiation (e-field), measuring a parameter related to the energization of the RF applicator, determining a drying cycle of operation in the controller based on the measured parameter, and controlling the energization of the RF applicator according to the determination of the drying cycle of operation, wherein the textile material is dried.

18 Claims, 10 Drawing Sheets

METHOD AND APPARATUS FOR DRYING ARTICLES

BACKGROUND OF THE INVENTION

Dielectric heating is the process in which a high-frequency alternating electric field heats a dielectric material, such as water molecules. At higher frequencies, this heating is caused by molecular dipole rotation within the dielectric material, while at lower frequencies in conductive fluids, other mechanisms such as ion-drag are more important in generating thermal energy.

Microwave frequencies are typically applied for cooking food items and are considered undesirable for drying laundry articles because of the possible temporary runaway thermal effects random application of the waves in a traditional microwave. Radio frequencies and their corresponding controlled and contained e-field are typically used for drying of textile material.

When applying an RF electronic field (e-field) to a wet article, such as a clothing material, the e-field may cause the water molecules within the e-field to dielectrically heat, generating thermal energy which effects the rapid drying of the articles.

BRIEF DESCRIPTION OF THE INVENTION

One aspect of the invention is directed to a method for drying textile material with a radio frequency (RF) applicator having an anode element, a cathode element, each anode and cathode element supported on a support element, and a controller, the method includes capacitively coupling the anode element to the cathode element, energizing the RF applicator to generate a field of electromagnetic radiation (e-field) within the radio frequency spectrum between the anode and cathode elements, measuring a parameter related to the energization of the RF applicator at each of the anode and cathode elements, determining a drying cycle of operation in the controller based on the measured parameter, and controlling the energization of the RF applicator according to the determination of the drying cycle of operation wherein liquid in textile material residing within the e-field will be dielectrically heated to effect a drying of the textile material.

Another aspect of the invention is directed to a textile material treating applicator for drying textile material according to a drying cycle of operation, including a textile material support element, an anode element and a cathode element supported by the textile material support element, a capacitive couple between the anode element and the cathode element, a radio frequency (RF) generator, and a controller. The RF generator is coupled to the anode element and the cathode element and selectively energizable to generate electromagnetic radiation in the radio frequency spectrum wherein the energization of the RF generator sends electromagnetic radiation through the applicator via the capacitive couple to form a field of electromagnetic radiation (e-field) in the radio frequency spectrum to dielectrically heat liquid within the textile material resting on the support element, and configured to output at least one signal indicative of the RF generator energization. The controller is coupled with the RF generator to receive the at least one RF generator energization signal and further configured to control the drying cycle of operation in response to the at least one RF generator energization signal.

DESCRIPTION OF EMBODIMENTS OF THE INVENTION

While this description may be primarily directed toward a textile material drying machine, embodiments of the invention may be applicable in any environment using a radio frequency (RF) signal application to dehydrate any wet article. While the primary example of textile material is described as laundry, embodiments of the invention may be applicable to any textile materials.

Figure 1:
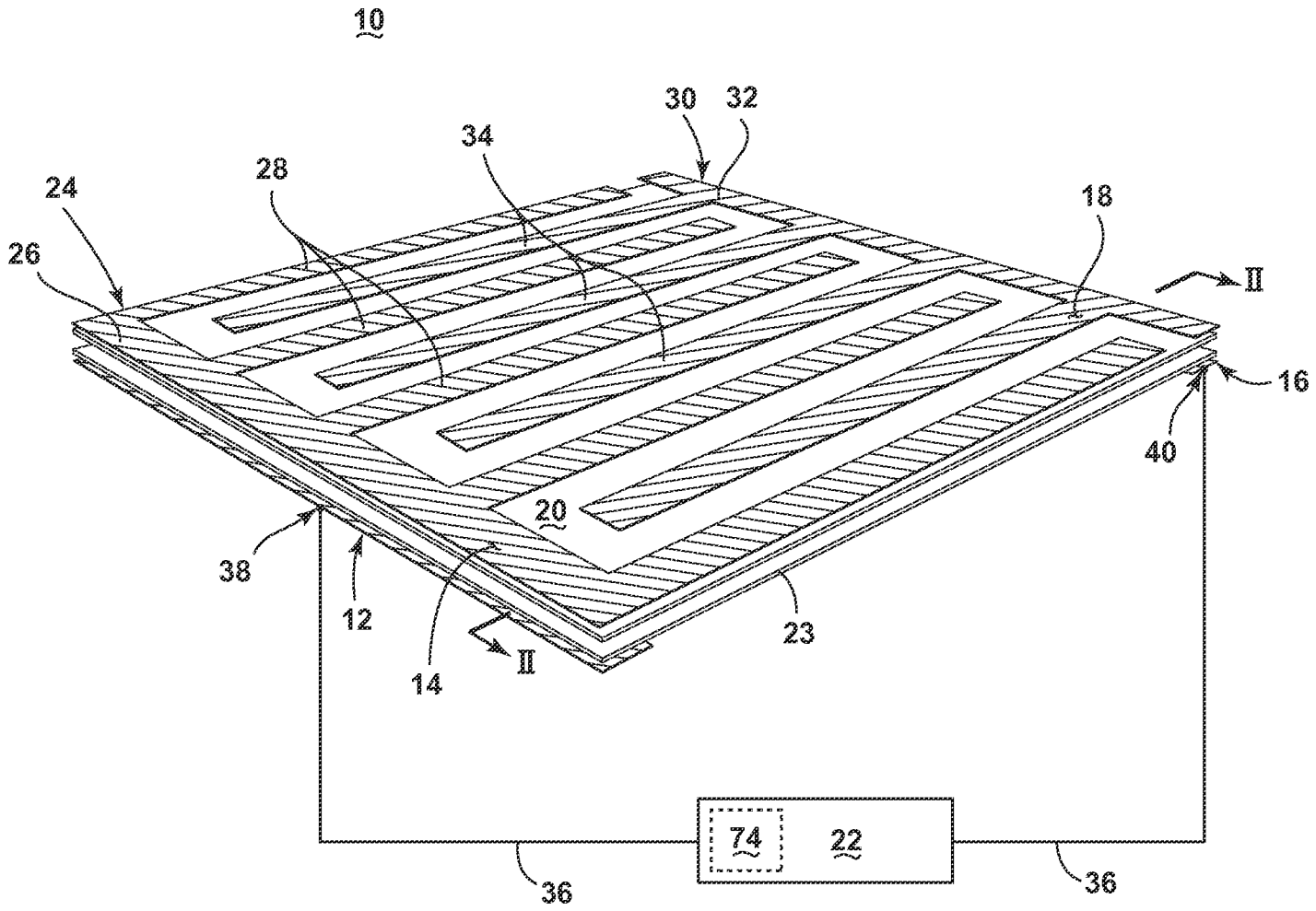
FIG. 1 is a schematic perspective view of the laundry treating applicator in accordance with the first embodiment of the invention.

FIG. 1 is a schematic illustration of a laundry treating applicator 10 according to the first embodiment of the invention for dehydrating one or more articles, such as articles of clothing. As illustrated in FIG. 1, the laundry treating applicator 10 has a structure that includes conductive elements, such as a first cathode element 12 and a second cathode element 14, and an opposing first anode element 16, a second anode element 18, in addition to a first non-conductive laundry support element 20, an optional second non-conductive support element 23, and an RF generator 22 having a controller 74. Although not shown, the laundry treating applicator 10 may also include a user interface wherein a user may input manually selected values for laundry characteristics, such as a size, quantity, material composition, acceptable heat level, and acceptable power level.

The second cathode element 14 further includes a first comb element 24 having a first base 26 from which extend a first plurality of teeth 28, and the second anode element 18 includes a second comb element 30 having a second base 32 from which extend a second plurality of teeth 34. The second cathode and second anode elements 14, 18 are fixedly mounted to the first supporting element 20 in such a way as to interdigitally arrange the first and second pluralities of teeth 28, 34. The second cathode and second anode elements 14, 18 may be fixedly mounted to the first support element 20 by, for example, adhesion, fastener connections, or laminated layers. Additionally, the first cathode and anode elements 12, 16 are shown fixedly mounted to the second support element 23 by similar mountings. Alternative mounting techniques may be employed.

At least a portion of either the first or second support elements 20, 23 separates an at least partially aligned first cathode and second cathode elements 12, 14. As illustrated, the elongated first cathode element 12 aligns with the substantially rectangular first base 26 portion of the second cathode element 14, through the first support element 20 and second support element 23, with the support elements 20, 23 separated by an optional air gap 70. Similarly shown, the elongated first anode element 16 at least partially aligns with the substantially rectangular second base 32 portion of the second anode element 18 through a portion of the first support element 20 and second support element 23, with the support elements 20, 23 separated by an air gap 70. The aligned portions of the first and second cathode elements 12, 14 are oppositely spaced, on the supporting elements 20, 23, from the aligned portion of the first and second anode elements 16, 18.

The RF generator 22 may be configured to generate a field of electromagnetic radiation (e-field) within the radio frequency spectrum between outputs electrodes and may be electrically coupled between the first cathode element 12 and the first anode element 16 by conductors 36 connected to at least one respective first anode and cathode contact point 38, 40. One such example of an RF signal generated by the RF generator 22 may be 13.56 MHz. The generation of another RF signal, or varying RF signals, is envisioned.

The controller 74 may include memory and may be configured to control the energization of the RF generator 22 according to a plurality of predetermined cycles of drying operation, which may be stored in the memory. Alternatively, the controller 74 may be configured to control the energization of the RF generator 22 according to a dynamic cycle of drying operation not stored in memory. Additionally, the controller 74 may be configured to measure or sense a parameter related to the energization of the RF generator 22, for instance, in at least one of the anode and/or cathode elements 12, 14, 16, 18. Examples of a parameter related to the energization of the RF generator 22 include, but are not limited to, voltage, current, impedance, power level, reflected power, and e-field strength directly or indirectly varied, such as with the use of fluorescent bulbs or near field antennas.

Microwave frequencies are typically applied for cooking food items. However, their high frequency and resulting greater dielectric heating effect make microwave frequencies undesirable for drying laundry articles. Radio frequencies and their corresponding lower dielectric heating effect are typically used for drying of laundry. In contrast with a conventional microwave heating appliance, where microwaves generated by a magnetron are directed into a resonant cavity by a waveguide, the RF generator 22 induces a controlled electromagnetic field between the cathode and anode elements 12, 14, 16, 18. Stray-field or through-field electromagnetic heating provides a relatively deterministic application of power as opposed to conventional microwave heating technologies where the microwave energy is randomly distributed (by way of a stirrer and/or rotation of the load). Consequently, conventional microwave technologies may result in thermal runaway effects or arcing that are not easily mitigated when applied to certain loads (such as metal zippers etc.). Stated another way, using a water analogy where water is analogous to the electromagnetic radiation, a microwave acts as a sprinkler while the above-described RF generator 22 is a wave pool. It is understood that the differences between microwave ovens and RF dryers arise from the differences between the implementation structures of applicator vs. magnetron/waveguide, which renders much of the microwave solutions inapplicable for RF dryers.

Each of the conductive cathode and anode elements 12, 14, 16, 18 remain at least partially spaced from each other by a separating gap, or by non-conductive segments, such as by the first and second support elements 20, 23, or by the optional air gap 70. The support elements 20, 23 may be made of any suitable low loss, fire retardant materials, or at least one layer of insulating materials that isolates the conductive cathode and anode elements 12, 14, 16, 18. The support elements 20, 23 may also provide a rigid structure for the laundry treating applicator 10, or may be further supported by secondary structural elements, such as a frame or truss system. The air gap 70 may provide enough separation to prevent arcing or other unintentional conduction, based on the electrical characteristics of the laundry treating applicator 10. Alternative embodiments are envisioned wherein the RF generator 22 is directly coupled to the respective second cathode and anode elements 14, 18.

Figure 2:
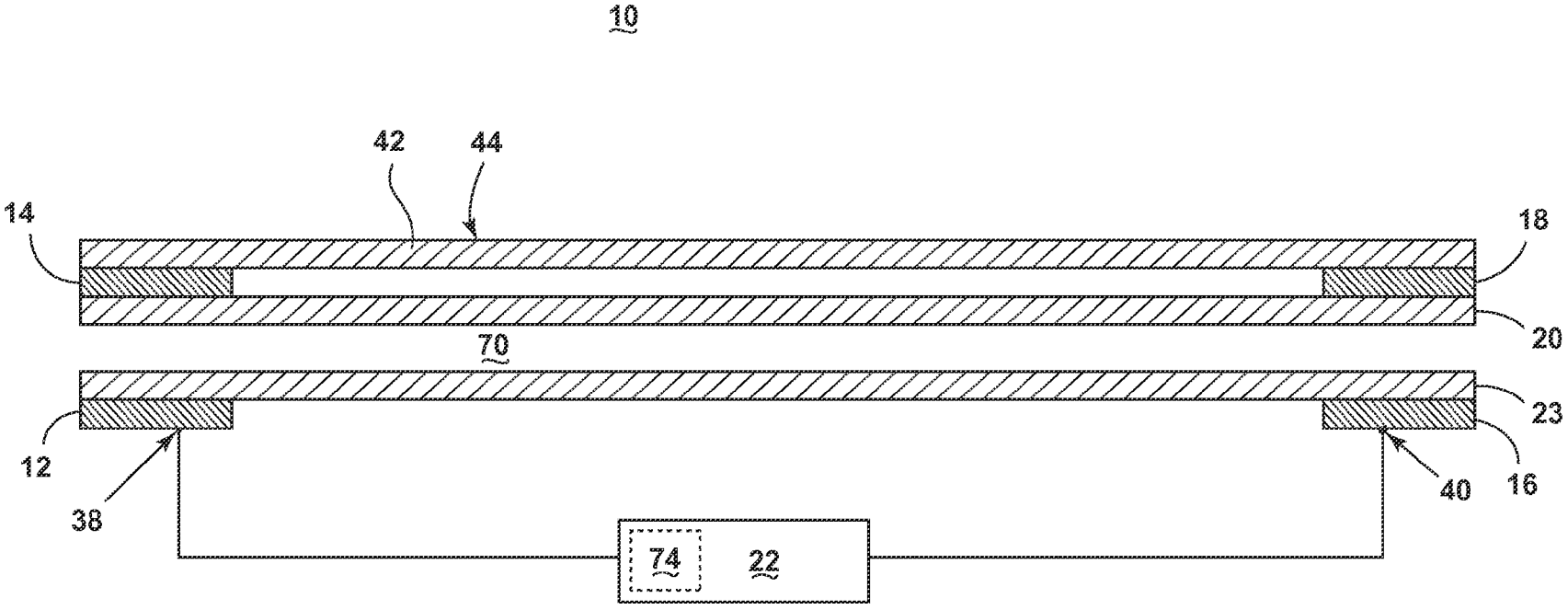
FIG. 2 is a partial sectional view taken along line 2-2 of FIG. 1 in accordance with the first embodiment of the invention.

Turning now to the partial sectional view of FIG. 2, taken along line 2-2 of FIG. 1 in accordance with the first embodiment of the invention, the first support element 20 may further include a non-conductive bed 42 wherein the bed 42 may be positioned above the interdigitally arranged pluralities of teeth 28, 34 (not shown in FIG. 2). The bed 42 further includes a substantially smooth and flat upper surface 44 for receiving wet laundry. The bed 42 may be made of any suitable low loss, fire retardant materials that isolate the conductive elements from the articles to be dehydrated.

The aforementioned structure of the laundry treating applicator 10 operates by creating a first capacitive coupling between the first cathode element 12 and the second cathode element 14 separated by at least a portion of the at least one support element 20, 23, a second capacitive coupling between the first anode element 16 and the second anode element 18 separated by at least a portion of the at least one support element 20, 23, and a third capacitive coupling between the pluralities of teeth 28, 34 of the second cathode element 14 and the second anode element 18, at least partially spaced from each other. During drying operations, wet laundry to be dried may be placed on the upper surface 44 of the bed 42. During, for instance, a predetermined cycle of operation, the RF generator 22 may be continuously or intermittently energized to generate an e-field between the first, second, and third capacitive couplings which interacts with liquid in the laundry. The liquid residing within the e-field will be dielectrically heated to effect a drying of the laundry.

Figure 3:
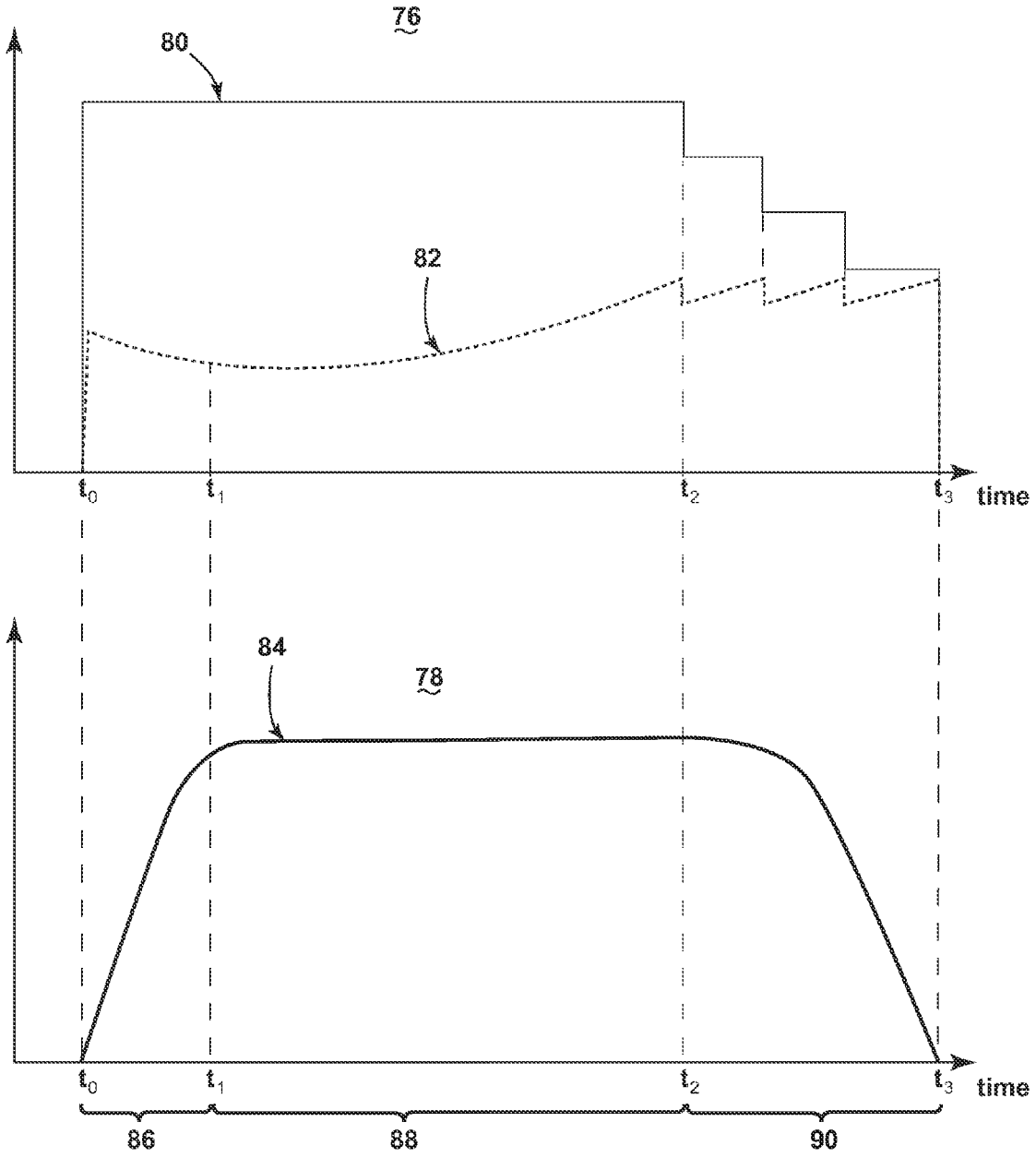
FIG. 3 illustrates an example drying cycle of operation of the laundry treating applicator in accordance with the first embodiment of the invention.

FIG. 3 illustrates an exemplary set of graphs depicting one example of the controller 74 controlling the energization of the RF generator 22, according to a cycle of drying operation, to effect the drying of the laundry. The top graph 76 illustrates the applied power level 80 of the RF generator 22, shown as a solid line, and a corresponding parameter related to the energization of the RF generator 22, represented as a plate voltage 82 across the anode to cathode elements 14, 18 and shown as a dotted line, as each power level and corresponding parameter changes over time. The bottom graph 78 illustrates the liquid extraction rate 84 corresponding to the matching time scale of the top graph 76.

The graphs 76, 78 are measured over time, which may be divided by several time periods separated by moments in time. The moments in time may include an initial time $t_0$ wherein the energization of the RF generator 22 begins, a first time $t_1$, a second time $t_2$, and a third time $t_3$, wherein the energization of the RF generator 22, and consequently, the drying operation, stops. The period of time between $t_0$ and $t_1$ defines a ramp-up period 86. The period of time between $t_1$ and $t_2$ defines a main extraction period 88. Additionally, the period of time between $t_2$ and $t_3$ defines a final extraction period 90.

During the ramp-up period 86, the RF generator 22 may be selectively energized to ramp-up the heating of the laundry, wherein the liquid is extracted at a growing rate. During the main extraction period, the liquid extraction rate is held at a substantially steady, high rate. Finally, during the final extraction period 90, the power levels 80 and plate voltage 82 are stepping lower over a number of intervals which the remaining water is heated from the laundry, corresponding with the falling liquid extraction rate. The power level 80 and plate voltage 82 stepping occurs due to the changing impedance of the drying laundry. As the water is removed from the laundry, the resistance of the laundry rises, and thus the impedance matching between the RF generator 22 and the laundry becomes unbalanced. The power levels 80 and plate voltages 82 are stepped down to allow for better impedance matching and prevent voltage arcing between the anode and cathode elements 12, 14, 16, 18, while keeping the applied power as high as possible to provide maximum water extraction rates. Additionally, the power level 80 stepping keeps power in the impedance matching circuit down, which reduces heat build up on the electrical components. The drying cycle of operation completes at time $t_3$, when the liquid extraction rate reaches zero, and thus, the laundry is sufficiently dry. Alternatively, the drying cycle of operation may complete when the liquid extraction rate falls below a threshold rate.

While there are no specific time indicators illustrated between $t_2$ and $t_3$ of the final extraction period 90, there may be a plurality of time stamps which denote the stepping operations. Additionally, it is envisioned there may be any number of stepping operations during the final extraction period 90. Also, while each the stepping operations of the final extraction period 90 appear last for the same amount of time, varying times are envisioned for each individual stepping operation.

As shown in the top graph 76, the controller 74 controls RF generator 22 to energize the e-field starting at time t0 at a constant power level 80, and holds this constant power level throughout the ramp-up period 86. During the ramp-up period 86, the controller 74 measures the parameter related to the energization, shown as the plate voltage 82, and uses this measured plate voltage 82 to determine a drying cycle of operation for the laundry.

For instance, the controller 74 may use the slope of the plate voltage 82 over the ramp-up period to determine the operating parameters for the rest of the drying cycle. In another example, the controller 74 may compare the measured plated voltage 82 against a reference voltage or value to determine a cycle of operation. In yet another example, the controller 74 may compare the measured plate voltage 82 over the ramp-up period against at least one predetermined cycle of operation, and select a cycle of operation for drying based on similarities or dissimilarities of the measured plate voltage 82 to the predetermined cycle. Additionally, the controller 74 may use the measured parameter related to the energization of the RF generator 22 to calculate a rate at which the textile is drying, the expected rate at which the textile is estimated to dry, the amount of time until the textile material is dry, and/or the amount of time until the drying operation is complete.

In yet another example, the controller 74 may use the parameter related to the energization of the RF generator 22 during the ramp-up period 86 to determine further operating characteristics of the RF generator 22 during the drying operation. For instance, the controller 74 may use the plate voltage 82 to determine a power level 80 to be used in upcoming steps, plate voltage 86, or acceptable plate voltage 86 ranges. In another example, the controller 74 may determine, for instance, a maximum power level 80, maximum plate voltage 82, or a plurality of maximum levels 80 and/or voltages 82 to be used during the following periods 88, 90.

In even yet another example, the controller 74 may use the parameter related to the energization of the RF generator 22 during the ramp-up period 86 to determine a textile material characteristic of the laundry. For instance, the controller 74 may use the plate voltage 82 to determine or estimate the laundry size, quantity, material composition, or acceptable heat levels for drying. The controller 74 may then use the textile material characteristic of the laundry to control the drying cycle of operation according to, for instance, a predetermined profile of drying operation for that material characteristic. In another example, the controller 74 may verify or compare a manually selected material characteristic against the determined material characteristic.

After the controller 74 has determined, measured, or sensed the parameter related to the energization of the RF generator 22, the controller may determine a drying cycle of operation and control the RF generator 22 throughout the main extraction and final extraction periods 88, 90 according to the determined drying cycle of operation. The controller 74 controls the RF generator 22 by controlling the selective energization of the generator 22 for the remaining cycle of operation. The drying cycle of operation may be a predetermined cycle stored in the controller 74 memory, or may be a dynamic profile, as repeatedly adjusted by a plurality of the determination steps, as described above. Either a predetermined or dynamic cycle of drying operation may define operating characteristics such as applied power level 80, acceptable reflected power, anode voltage, cathode voltage, an impedance profile for the RF generator 22, or a maximum value for any above-mentioned operating characteristic or characteristics. Additionally, the operating characteristics may be defined or determined to prevent electrical arcing between the anode and cathode elements 12, 14, 16, 18 during operation.

While the power level 80 is shown remaining steady during the ramp-up period 86, it is envisioned that the level 80 may change dynamically over the ramp-up period 86 in immediate response to the measured parameter relating to the energization of the RF generator 22. Alternatively, the controller 74 may continuously, selectively, or intermittently determine the drying cycle of operation in the ramp-up period 86, the main extraction period 88, and/or the final extraction period 90 to verify the cycle of operation, compare the expected cycle of operation against the actual cycle of operation, or to dynamically adjust the drying cycle of operation.

While the parameter related to the energization of the RF generator 22 is illustrated as the plate voltage 82, additional parameters are envisioned, such as reflected power applied, anode voltage, cathode voltage, and/or impedance. Alternatively, the laundry treating applicator 10 may also include an impedance matching circuit, wherein the circuit may provide a signal or value to the controller 74 representative of the actual or estimated impedance, or the actual or estimated impedance profile of the RF generator 22. Additionally, the top graph 76 and bottom graph 78 merely represent one example of a drying cycle of operation, and thus, alternative period 86, 88, 90 length, power levels 80, plate voltages 82, and stepping operation during the final extraction period 90 are envisioned. For instance, the constant power level 80 during the ramp-up and main extraction periods 86, 88 may be a predetermined level 80 based on a sensed or manually entered characteristic of the laundry load, or may additionally start low and ramp-up, as determined necessary by the controller 74.

Many other possible configurations in addition to that shown in the above figures are contemplated by the present embodiment. For example, the RF generator 22 may be directly connected to the respective second cathode and anode elements 14, 18. In another configuration, one embodiment of the invention contemplates different geometric shapes for the laundry treating applicator, such as substantially longer, rectangular applicator 10 where the cathode and anode elements 12, 14, 16, 18 are elongated along the length of the applicator 10, or the longer applicator 10 includes a plurality of cathode and anode element 12, 14, 16, 18 sets. In such a configuration, the upper surface 44 of the bed 42 may be smooth and slightly sloped to allow for the movement of wet laundry or water across the laundry treating applicator 10, wherein the one or more cathode and anode element 12, 14, 16, 18 sets may be energized individually or in combination by one or more RF generators 22 to dry the laundry as it traverses the applicator 10. Alternatively, the bed 42 may be mechanically configured to move across the elongated laundry treating applicator 10 in a conveyor belt operation, wherein the one or more cathode and anode element 12, 14, 16, 18 sets may be energized individually or in combination by one or more RF generators 22 to dry the laundry as it traverses the applicator 10.

Additionally, a configuration is envisioned wherein only a single support element 20 separates the first cathode and anode elements 12, 16 from their respective second cathode and anode elements 14, 18. This configuration may or may not include the optional air gap 70. In another embodiment, the first cathode element 12, first anode element 16, or both elements 12, 16 may be positioned on the opposing side of the second support element 23, within the air gap 70. In this embodiment, the air gap 70 may still separate the elements 12, 16 from the first support element 20, or the elements 12, 16 may be in communication with the first support element 20. In another configuration, a failure of a component, such as the impedance matching circuit or RF generator 22, may be detected by unexpected spikes or dips in the parameter related to the energization of the RF generator 22, and the laundry treating applicator 10 may respond by, for instance, stopping the cycle of operation.

Figure 4:
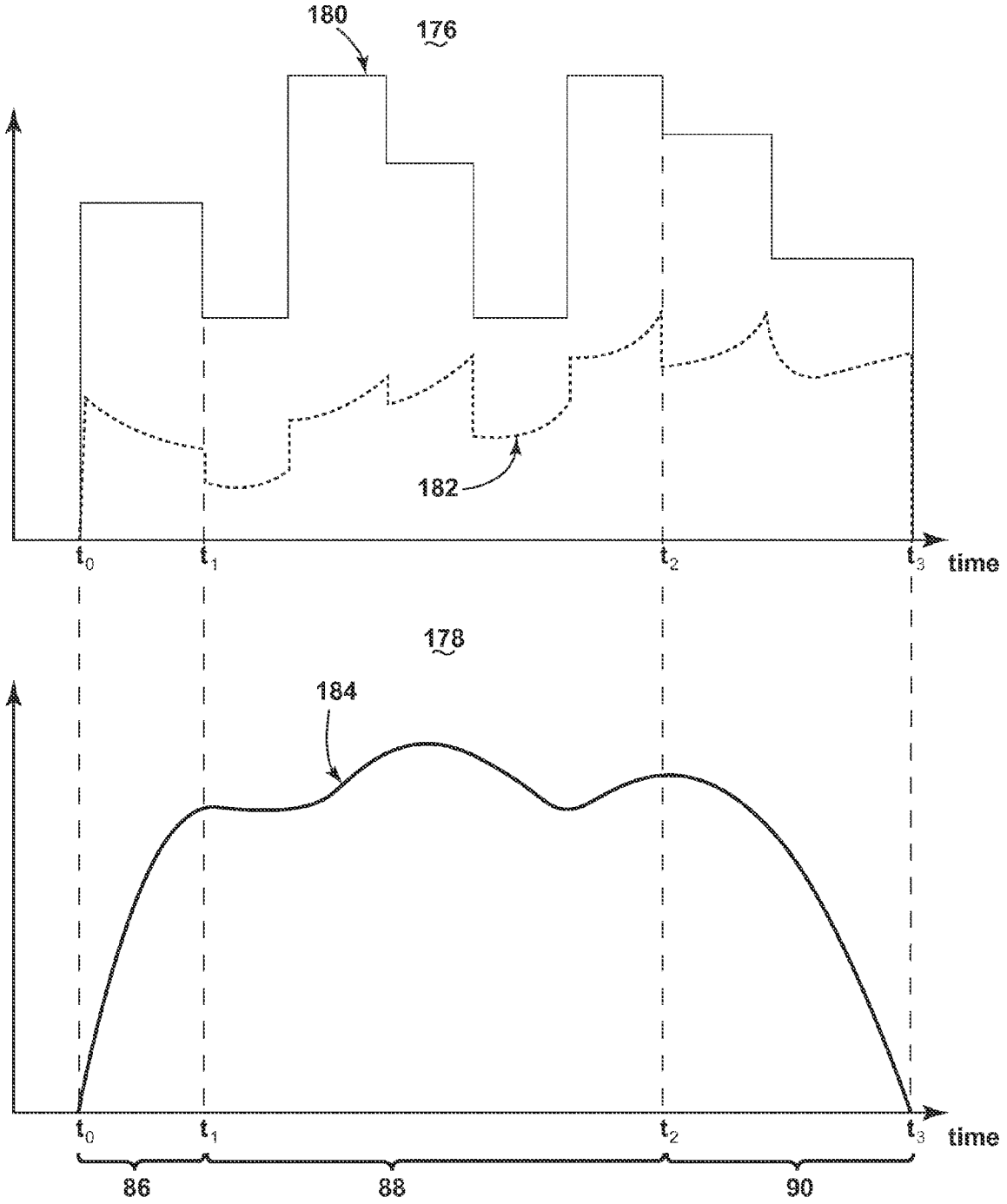
FIG. 4 illustrates an alternative example drying cycle of operation of the laundry treating applicator in accordance with the first embodiment of the invention.

Many alternative control cycles of operation are envisioned as well. For instance, FIG. 4 illustrates an alternative set of graphs 176, 178 depicting another example of the controller 74 controlling the energization of the RF generator 22, according to a cycle of drying operation, to effect the drying of the laundry. The top graph 176 illustrates the applied power level 180 of the RF generator 22, as it varies over time based on the controller instruction, and a corresponding plate voltage 182 across the anode to cathode elements 14, 18. The bottom graph 178 illustrates the varying liquid extraction rate 184 corresponding to the matching time scale of the top graph 176. It is envisioned that alternative control cycles of operation, for example, like the one illustrated in FIG. 4, may provide for further decreased drying time for an article or textile. An alternative control cycle may also provide for more precise control over the drying of particularly delicate articles, such as silk, or mixed-load articles, wherein the composition of the article load may have more than one type of material, and therefore, have different preferred drying cycles of operation.

Figure 5:
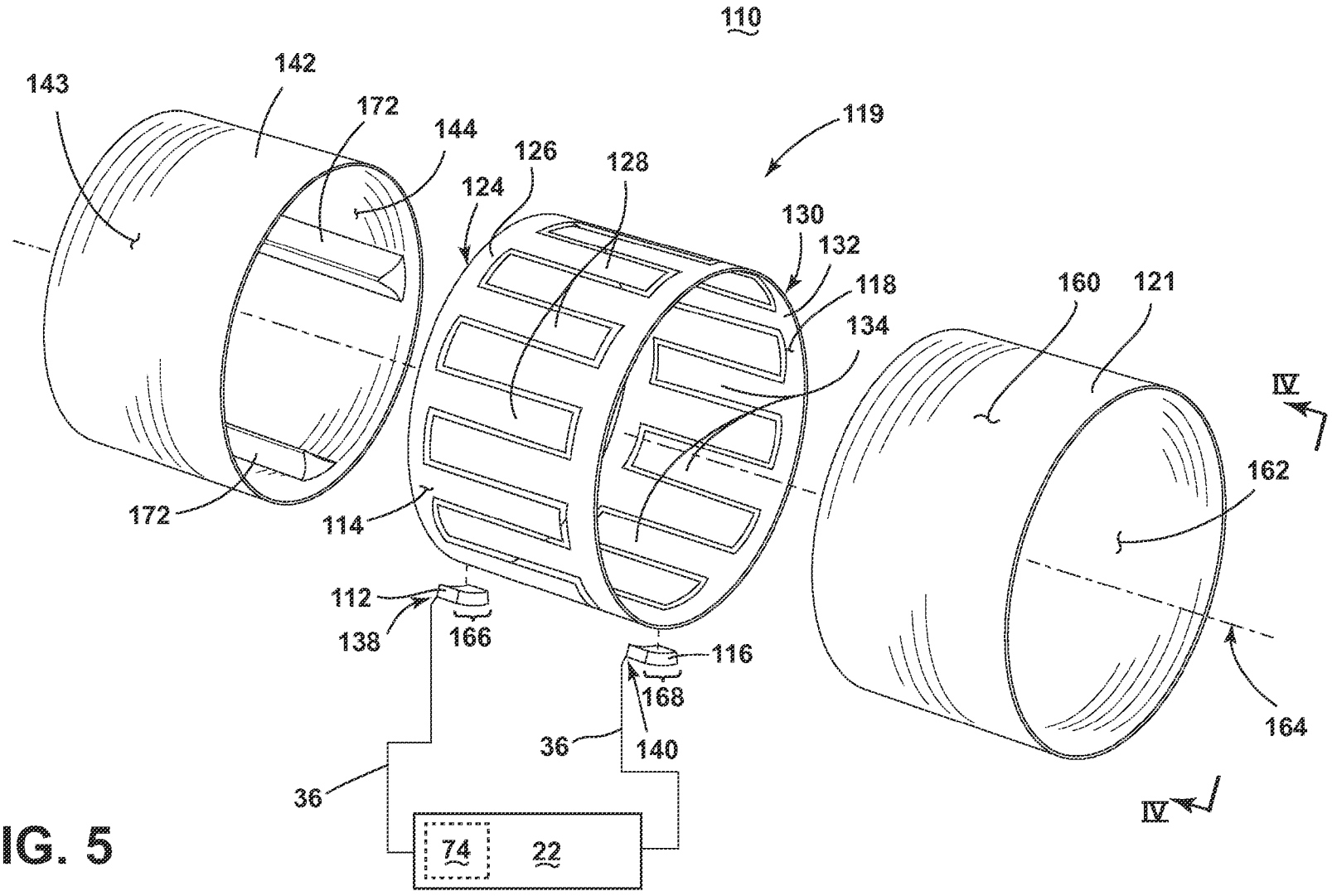
FIG. 5 is a schematic perspective view of an axially-exploded laundry treating applicator with a rotating drum configuration, in accordance with the second embodiment of the invention.

Furthermore, FIG. 5 illustrates an alternative laundry treating applicator 110 according to a second embodiment of the invention. The second embodiment may be similar to the first embodiment; therefore, like parts will be identified with like numerals increased by 100, with it being understood that the description of the like parts of the first embodiment applies to the second embodiment, unless otherwise noted. A difference between the first embodiment and the second embodiment may be that laundry treating applicator 110 may be arranged in a drum-shaped configuration rotatable about a rotational axis 164, instead of the substantially flat configuration of the first embodiment.

In this embodiment, the support element includes a drum 119 having a non-conducting outer drum 121 having an outer surface 160 and an inner surface 162, and may further include a non-conductive element, such as a sleeve 142. The sleeve 142 further includes an inner surface 144 for receiving and supporting wet laundry. The inner surface 144 of the sleeve 142 may further include optional tumble elements 172, for example, baffles, to enable or prevent movement of laundry. The sleeve 142 and outer drum 121 may be made of any suitable low loss, fire retardant materials that isolate the conductive elements from the articles to be dehydrated. While a sleeve 142 is illustrated, other non-conductive elements are envisioned, such as one or more segments of non-conductive elements, or alternate geometric shapes of non-conductive elements.

As illustrated, the conductive second cathode element 114, and the second anode elements 118 are similarly arranged in a drum configuration and fixedly mounted to the outer surface 143 of the sleeve 142. In this embodiment, the opposing first and second comb elements 124, 130 include respective first and second bases 126, 132 encircling the rotational axis 164, and respective first and second pluralities of teeth 128, 134, interdigitally arranged about the rotational axis 164.

The laundry treating applicator 110 further includes a conductive first cathode element comprising at least a partial cathode ring 112 encircling a first radial segment 166 of the drum 119 and an axially spaced opposing conductive first anode element comprising at least a partial anode ring 116 encircling a second radial segment 168 of the drum 119, which may be different from the first radial segment 166. As shown, at least a portion of the drum 119 separates the at least partially axially-aligned cathode ring 112 and the first base 126 portion of the second cathode elements 114. Similarly, at least a portion of the drum 119 separates the at least partially axially-aligned anode ring 116 and the second base 132 portion of the second anode element 118. Additionally, this configuration aligns the first base 126 with the first radial segment 166, and the second base 132 with the second radial segment 168. Alternate configurations are envisioned where only at least a portion of the drum 119 separates the cathode or anode rings 112, 116 from their respective first and second bases 126, 132.

The RF generator 22 may be configured to generate a field of electromagnetic radiation (e-field) within the radio frequency spectrum between outputs electrodes and may be electrically coupled between the cathode ring 112 and the anode ring 116 by conductors 36 connected to at least one respective cathode and anode ring contact point 138, 140.

Each of the conductive cathode and anode elements 112, 114, 116, 118 remain at least partially spaced from each other by a separating gap, or by non-conductive segments, such as by the outer drum 121. The outer drum 121 may be made of any suitable low loss, fire retardant materials, or at least one layer of insulating materials that isolates the conductive cathode and anode elements 112, 114, 116, 118. The drum 119 may also provide a rigid structure for the laundry treating applicator 110, or may be further supported by secondary structural elements, such as a frame or truss system.

Figure 6:
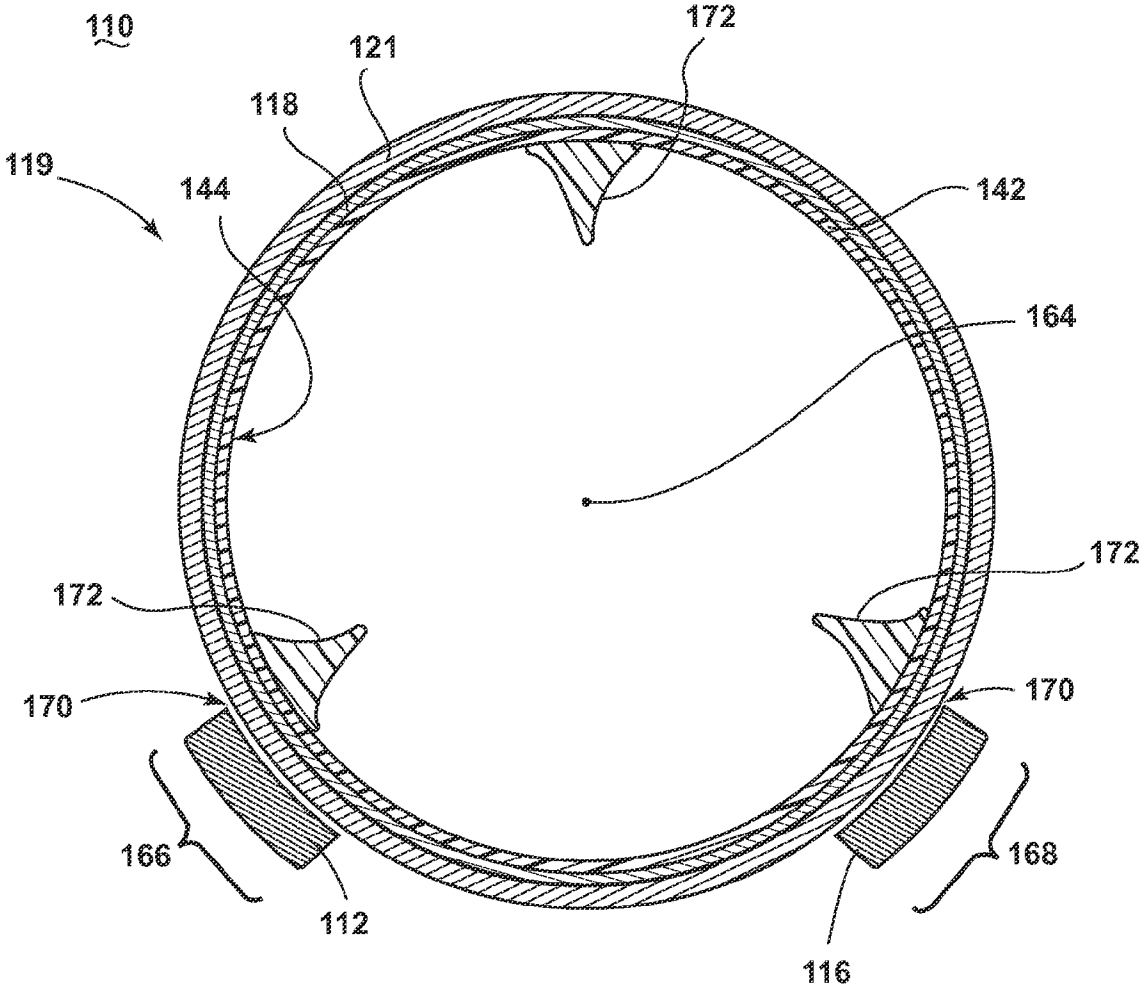
FIG. 6 is a partial sectional view taken along line 4-4 of FIG. 5 showing the assembled configuration of the drum and anode/cathode elements, in accordance with the second embodiment of the invention.

As shown in FIG. 6, the assembled laundry treating applicator 110, according to the second embodiment of the invention, creates a substantially radial integration between the sleeve 142, second cathode and anode elements 114, 118 (cathode element not shown), and drum 119 elements. It may be envisioned that additional layers may be interleaved between the illustrated elements. Additionally, while the cathode ring 112 and anode ring 116 are shown offset about the rotational axis for illustrative purposes, alternate placement of each ring 112, 116 may be envisioned.

The second embodiment of the laundry treating applicator 110 operates by creating a first capacitive coupling between the cathode ring 112 and the second cathode element 114 separated by at least a portion of the drum 119, a second capacitive coupling between the anode ring 116 and the second anode element 118 separated by at least a portion of the drum 119, and a third capacitive coupling between the pluralities of teeth 128, 134 of the second cathode element 114 and the second anode element 118, at least partially spaced from each other.

During drying operations, wet laundry to be dried may be placed on the inner surface 144 of the sleeve 142. During a cycle of operation, the drum 119 may rotate about the rotational axis 164 at a speed at which the tumble elements 172 may enable, for example, a folding or sliding motion of the laundry articles. During rotation, the RF generator 22 may be off, or may be continuously or intermittently energized to generate an e-field between the first, second, and third capacitive couplings which interacts with liquid in the laundry. The liquid interacting with the e-field located within the inner surface 144 will be dielectrically heated to effect a drying of the laundry.

Many other possible configurations in addition to that shown in the above figures are contemplated by the present embodiment. For example, in another configuration, the cathode and anode rings 112, 116 may encircle larger or smaller radial segments, or may completely encircle the drum 119 at first and second radial segments 166, 168, as opposed to just partially encircling the drum 119 at a first and second radial segments 166, 168. In yet another configuration, the first and second bases 126 and 132 and the first and second plurality of teeth 128, 134 may only partially encircle the drum 119 as opposed to completely encircling the drum 119. In even another configuration, the pluralities of teeth 28, 34, 128, 134 may be supported by slotted depressions in the support element 20 or sleeve 142 matching the teeth 28, 34, 128, 134 for improved dielectric, heating, or manufacturing characteristics of the applicator. In another configuration, the second cathode and anode elements 114, 118 may only partially extend along the outer surface 143 of the sleeve 142. In yet another configuration, the RF generator 22 may directly connect to the respective second cathode and anode elements 114, 118.

In an alternate operation of the second embodiment, the RF generator 22 may be intermittently energized to generate an e-field between the first, second, and third capacitive couplings, wherein the intermittent energizing may be related to the rotation of the drum 119, or may be timed to correspond with one of aligned capacitive couplings, tumbling of the laundry, or power requirements of the laundry treating applicator 110. In another alternate operation of the second embodiment, the RF generator 22 may be moving during the continuous or intermittent energizing of the e-field between the first, second, and third capacitive couplings. For instance, the RF generator 22 may rotate about the rotational axis 164 at similar or dissimilar periods and directions as the drum 119. In yet another alternate operation of the second embodiment, the drum may be rotationally stopped or rotationally slowed while the RF generator 22 continuously or intermittently energizes to generate an e-field between the first, second, and third capacitive couplings.

Figure 7:
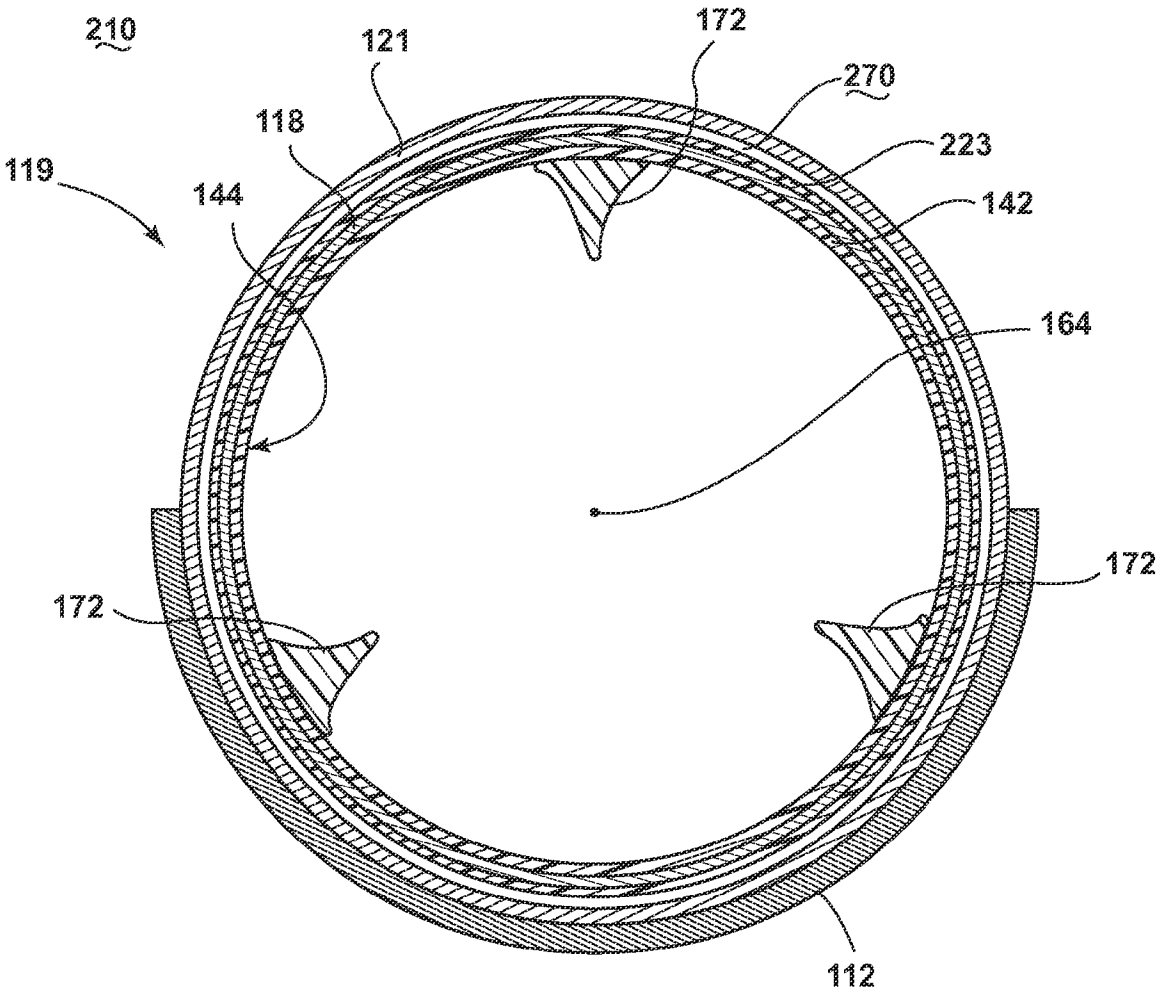
FIG. 7 is a partial sectional view showing an alternate assembled configuration of the drum and anode/cathode elements, in accordance with the third embodiment of the invention.

FIG. 7 illustrates an alternative assembled laundry treating applicator 210, according to the third embodiment of the invention. The third embodiment may be similar to the first and second embodiments; therefore, like parts will be identified with like numerals increased by 200, with it being understood that the description of the like parts of the first and second embodiment applies to the third embodiment, unless otherwise noted. A difference between the first embodiment and the second embodiment may be that laundry treating applicator 210 may be arranged in a drum-shaped configuration, wherein the outer drum 121 is separated from the second anode element 118 by a second drum element 223 and an air gap 270.

Additionally, the same anode ring 116 and cathode ring 112 (not shown) are elongated about a larger radial segment of the drum 119. Alternatively, the cathode ring 112, anode ring 116, or both rings 112, 116 may be positioned on the opposing side of the outer drum 121, within the air gap 270. In this embodiment, the air gap 270 may still separate the elements 112, 116 from the second drum element 223, or the elements 112, 116 may be in communication with the second drum element 223. The operation of the third embodiment is similar to that of the second embodiment.

Figure 8:
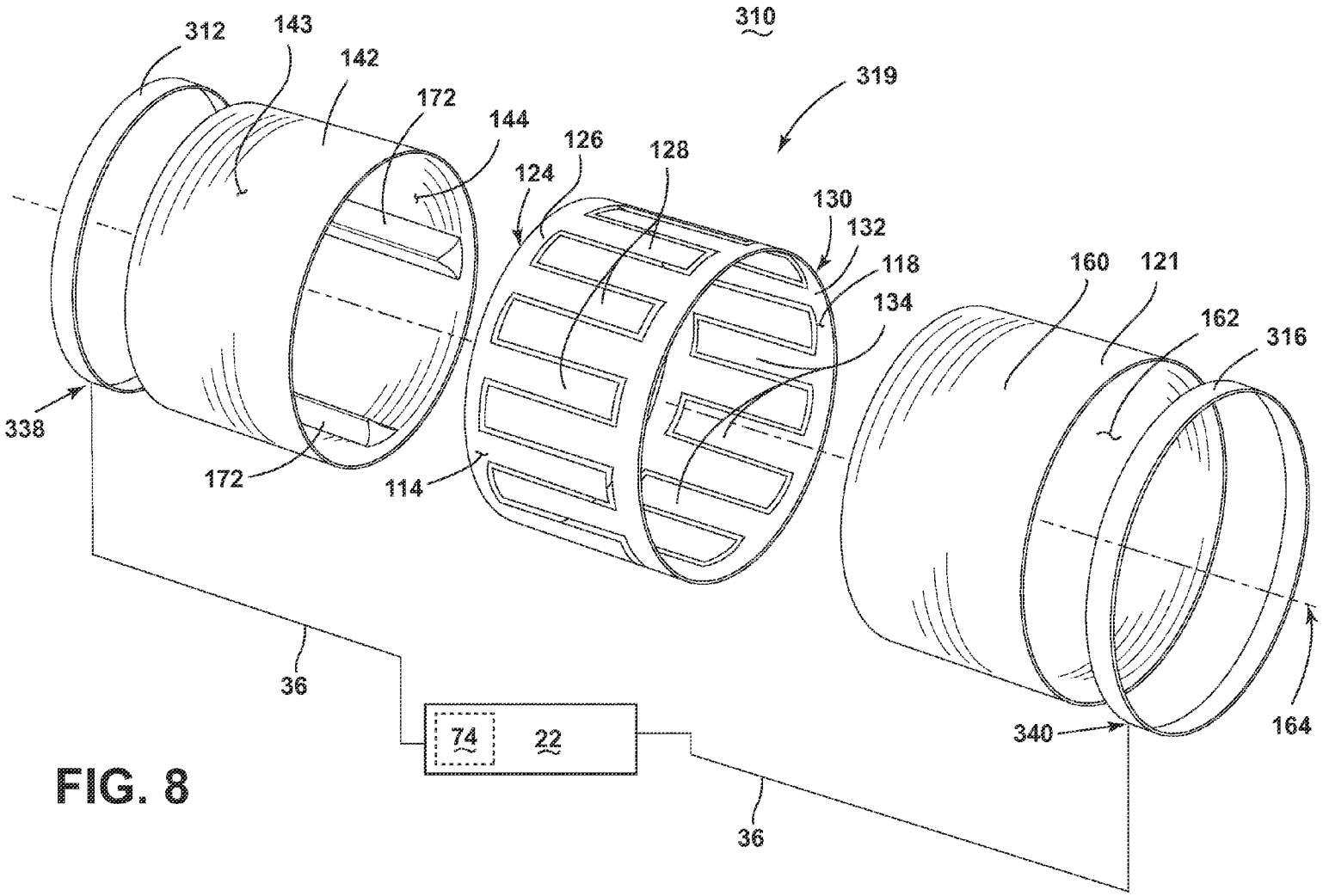
FIG. 8 is a schematic perspective view of an axially-exploded laundry treating applicator with a rotating drum configuration having integrated anode/cathode rings, in accordance with the fourth embodiment of the invention.

FIG. 8 illustrates an alternative laundry treating applicator 310 according to a fourth embodiment of the invention. The fourth embodiment may be similar to the second or third embodiments; therefore, like parts will be identified with like numerals beginning with 300, with it being understood that the description of the like parts of the first, second, and third embodiments apply to the fourth embodiment, unless otherwise noted. A difference between the prior embodiments and the fourth embodiment may be that first cathode and anode elements include cathode and anode rings 312, 316 assembled at axially opposite ends of the drum 319. This configuration may be placed within a housing, for instance, a household dryer cabinet (not shown).

In this embodiment, the assembled cathode and anode rings 312, 316 are electrically isolated by, for example, at least a portion of the drum 319 or air gap (not shown). In this sense, the laundry treating applicator 310 retains the first and second capacitive couplings of the second embodiment.

The RF generator 22 may be configured to generate a field of electromagnetic radiation (e-field) within the radio frequency spectrum between outputs electrodes and may be electrically coupled between the cathode ring 312 and the anode ring 316 by conductors 36 connected to at least one respective cathode and anode ring contact point 338, 340. In this embodiment, the cathode and anode ring contact points 338, 340 may further include direct conductive coupling through additional components of the dryer cabinet supporting the rotating drum 319, such as via ball bearings, or via an RF slip ring. Other direct conductive coupling through additional components of the dryer cabinet may be envisioned.

The fourth embodiment of the laundry treating applicator 310 operates by creating a first capacitive coupling between the cathode ring 312 and the second cathode element 114 separated by at least a portion of the drum 319 or air gap, a second capacitive coupling between the anode ring 316 and the second anode element 118 separated by at least a portion of the drum 319 or air gap. During rotation, the RF generator 22 may be off, or may be continuously or intermittently energized to generate an e-field between the first, second, and third capacitive couplings which interacts with liquid in the laundry. The liquid interacting with the e-field located within the inner surface 144 will be dielectrically heated to effect a drying of the laundry.

Figure 9:
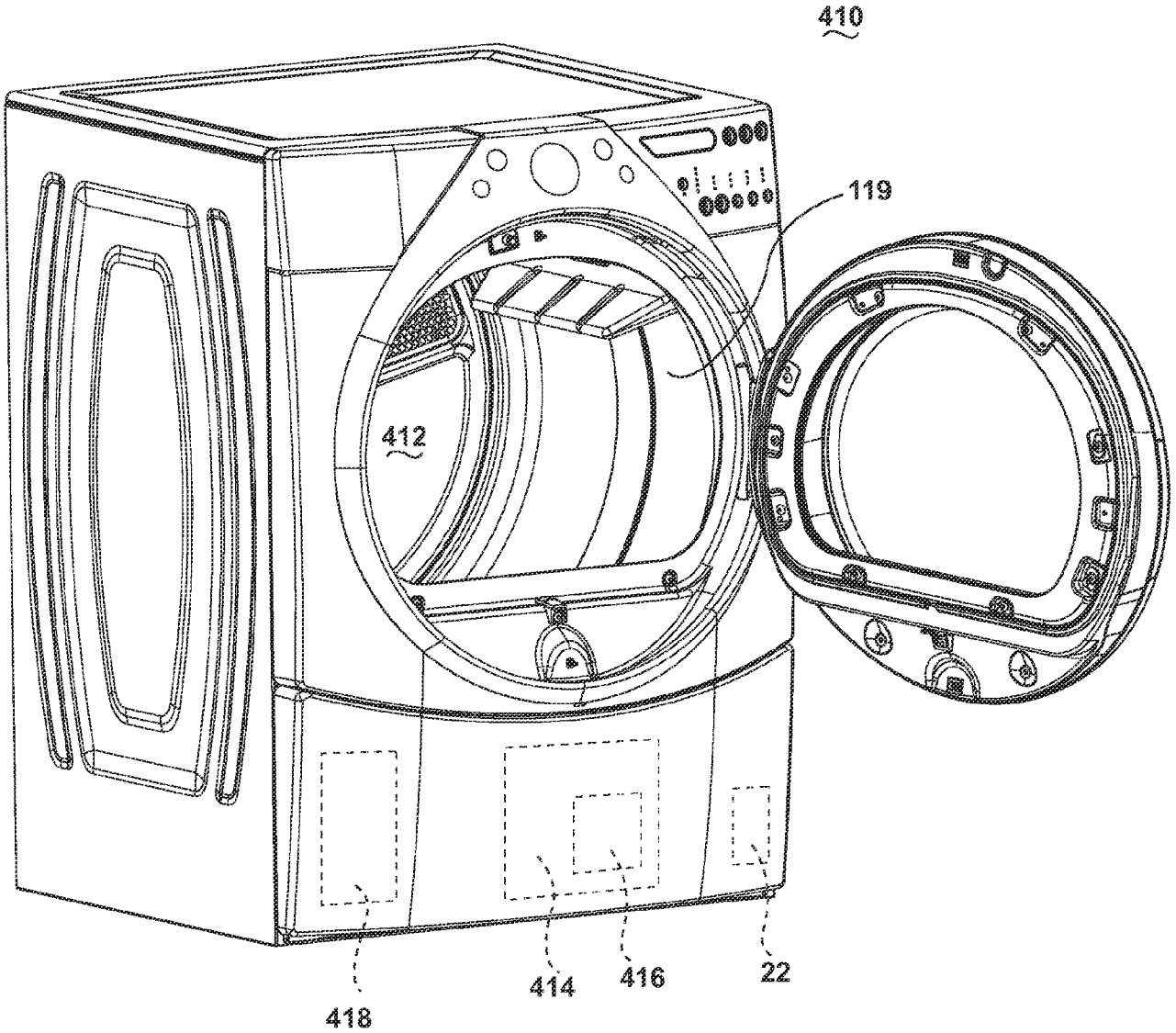
FIG. 9 is a schematic perspective view of an embodiment where the laundry treating appliance is shown as a clothes dryer incorporating the drum of the second, third, and fourth embodiments.

FIG. 9 illustrates an embodiment where the applicator is included in a laundry treating appliance, such as a clothes dryer 410, incorporating the drum 119, 219, 319 (illustrated as drum 119), which defines a treating chamber 412 for receiving laundry for treatment, such as drying. The clothes dryer comprises an air system 414 supplying and exhausting air from the treating chamber, which includes a blower 416. A heating system 418 is provided for hybrid heating the air supplied by the air system 414, such that the heated air may be used in addition to the dielectric heating. The heating system 418 may work in cooperation with the laundry treating applicator 110, as described herein.

Figure 10:
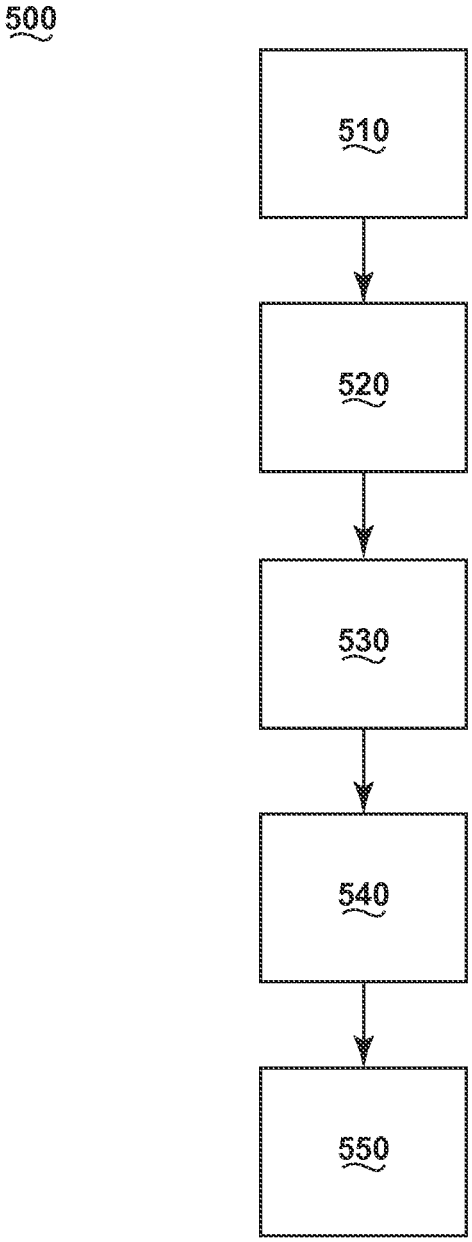
FIG. 10 is a flow chart illustrating a method for drying textile material according to an embodiment of the invention.

FIG. 10 shows a flow chart illustrating a method 500 for drying textile material according to an embodiment of the invention. The method 500 begins with a capacitively coupling step 510, wherein the anode and cathode elements are capacitively coupled to each other. Next, in an energizing step 520, the RF generator 22 is selectively energized to generate an e-field within the radio frequency spectrum between the capacitively coupled anode and cathode elements. A measuring step 530 then measures the parameter related to the energization of the RF generator 22 at each of the anode and cathode elements. The measurement of the parameter is performed according to the above-described embodiments and examples. Next, a determining step 540 determines a drying cycle of operation in the controller 74, based on the measured parameter. The determination is performed according to the above-described embodiments and examples. Finally, a controlling step 550 occurs, wherein the controller 74 controls the energization of the RF generator 22 according to the drying cycle of operation, determined by the determining step 540, wherein liquid in textile material residing within the e-field will be dielectrically heated to effect a drying of the textile material, until the cycle and/or method 500 completes. Alternative cycles are envisioned which include additional method steps, as described above.

Many other possible embodiments and configurations in addition to those shown in the above figures are contemplated by the present disclosure. For example, alternate geometric configurations of the first and second pluralities of teeth are envisioned wherein the interleaving of the teeth are designed to provide optimal electromagnetic coupling while keeping their physical size to a minimum. Additionally, the spacing between the pluralities of teeth may be larger or smaller than illustrated.

The embodiments disclosed herein provide a laundry treating applicator using RF generator to dielectrically heat liquid in wet articles to effect a drying of the articles. One advantage that may be realized in the above embodiments may be that the above described embodiments are able to dry articles of clothing during rotational or stationary activity, allowing the most efficient e-field to be applied to the clothing for particular cycles or clothing characteristics. A further advantage of the above embodiments may be that the above embodiments allow for selective energizing of the RF generator according to such additional design considerations as efficiency or power consumption during operation.

Additionally, the design of the anode and cathode may be controlled to allow for individual energizing of particular RF generators in a single or multi-generator embodiment. The effect of individual energization of particular RF generators results in avoiding anode/cathode pairs that would result in no additional material drying (if energized), reducing the unwanted impedance of additional anode/cathode pairs and electromagnetic fields inside the drum, and an overall reduction to energy costs of a drying cycle of operation due to increased efficiencies. Finally, reducing unwanted fields will help reduce undesirable coupling of energy into isolation materials between capacitive coupled regions.

Moreover, the capacitive couplings in embodiments of the invention allow the drying operations to move or rotate freely without the need for physical connections between the RF generator and the pluralities of teeth. Due to the lack of physical connections, there will be fewer mechanical couplings to moving or rotating embodiments of the invention, and thus, an increased reliability appliance.

Additionally, the embodiments herein provide a laundry treating applicator configured to create a custom cycle of drying for the laundry, or determine an optimized drying cycle of operation according to the material characteristics and available power levels. By adjusting the drying cycle of operation, the appliance may perform the cycle faster, and dry the laundry more completely, saving a user time and effort while avoiding additional drying cycles.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A textile material treating applicator for drying textile material according to a drying cycle of operation, comprising:

a textile material support element;

an anode element and a cathode element supported by the textile material support element;

a capacitive couple between the anode element and the cathode element;

a radio frequency (RF) generator coupled to the anode element and the cathode element and selectively energizable to generate electromagnetic radiation in the radio frequency spectrum wherein the energization of the RF generator sends electromagnetic radiation through the applicator via the capacitive couple to form a field of electromagnetic radiation (e-field) in the radio frequency spectrum to dielectrically heat liquid within the textile material resting on the support element, and configured to output at least one signal indicative of the RF generator energization; and a controller coupled with the RF generator to receive the at least one RF generator energization signal and further configured to control the drying cycle of operation in response to the at least one RF generator energization signal.

2. The textile material treating applicator of claim 1 wherein the textile material support element comprises a bed, with the textile material supported on an upper surface of the bed.

3. The textile material treating applicator of claim 1 wherein the textile material support element comprises a rotatable drum with inner and outer surfaces and the textile material is supported on the inner surface.

4. The textile material treating applicator of claim 1 wherein the at least one generator energization signal comprises at least one of power level, reflected power, anode voltage, cathode voltage, or impedance.

5. The textile material treating applicator of claim 4, further comprising an impedance matching circuit wherein the at least one generator energization signal further includes a signal transmitted from the impedance matching circuit to the controller.

6. The textile material treating applicator of claim 1 wherein the controller is further configured to receive at least one input associated with at least one textile material characteristic, wherein the at least one textile material characteristic comprises at least one of textile material size, quantity, material, or heat level.

7. The textile material treating applicator of claim 6, further comprising a user interface wherein the at least one textile material characteristic is user-selectable.

8. The textile material treating applicator of claim 6 wherein the controller determines the at least one textile material characteristic from the at least one RF generator energization signal.

9. The textile material treating applicator of claim 8, further comprising an impedance matching circuit wherein the at least one generator energization signal further includes a signal transmitted from the impedance matching circuit to the controller.

10. The textile material treating applicator of claim 1 wherein the controller further comprises a memory in which is stored at least one predetermined cycle of operation.

11. The textile material treating applicator of claim 10 wherein the controller is configured to compare the at least one RF generator energization signal to the at least one predetermined cycle of operation.

12. The textile material treating applicator of claim 10 wherein the controller is configured to control the drying cycle of operation in accordance to the at least one predetermined cycle of operation.

13. The textile material treating applicator of claim 12 wherein the controller is configured to control the drying cycle of operation by control of the selective energization of the RF generator.

14. The textile material treating applicator of claim 13 wherein the at least one predetermined cycle of operation further defines at least one of a power level, a reflected power, an anode voltage, a cathode voltage, or an impedance profile for the RF applicator.

15. The textile material treating applicator of claim 14 wherein the at least one predetermined cycle of operation defines at least one of a maximum power level, a maximum reflected power, a maximum anode voltage, a maximum cathode voltage, or a maximum impedance profile for the RF generator.

16. The textile material treating applicator of claim 15 wherein the at least one maximum power level, maximum reflected power, maximum anode voltage, maximum cathode voltage, or maximum impedance profile is defined such that electrical arcing is prevented.

17. The textile material treating applicator of claim 1 wherein the controller is configured to control the drying cycle of operation by controlling the selective energization of the RF generator.

18. The textile material treating applicator of claim 1 further comprising a plurality of capacitive couplings between a plurality of anode elements and cathode elements, and wherein the RF generator is selectively energizable to generate electromagnetic radiation via individual capacitive couplings.

* * * * *